United States Patent [19]

Foster

[11] Patent Number: 4,724,677

[45] Date of Patent: Feb. 16, 1988

[54] CONTINUOUS CRYOPUMP WITH A DEVICE FOR REGENERATING THE CRYOSURFACE

[76] Inventor: Christopher A. Foster, Rte. 5, Box 101-B, Clinton, Tenn. 37716

[21] Appl. No.: 917,197

[22] Filed: Oct. 9, 1986

[51] Int. Cl.[4] ..... B01D 8/00

[52] U.S. Cl. ..... 62/55.5; 55/269; 62/268; 62/284; 62/354; 165/94; 417/901

[58] Field of Search ..... 165/94; 62/55.5, 100, 62/268, 71, 284, 353, 354; 55/269; 417/901

[56] References Cited

U.S. PATENT DOCUMENTS

| | | | |
|---|---|---|---|
| 2,919,561 | 1/1960 | Lee | 62/71 |
| 3,031,273 | 4/1962 | Latinen | 165/94 |
| 3,144,200 | 8/1964 | Taylor et al. | 62/55.5 |
| 3,585,807 | 6/1971 | Hengevoss et al. | 62/55.5 |
| 3,721,101 | 3/1973 | Sheppard et al. | 62/55.5 |
| 4,363,217 | 12/1982 | Venuti | 62/55.5 |
| 4,438,632 | 3/1984 | Lessard et al. | 417/901 |
| 4,485,631 | 12/1984 | Winkler | 62/55.5 |

*Primary Examiner*—Ronald C. Capossela
*Attorney, Agent, or Firm*—Pitts and Brittian

[57] ABSTRACT

A high throughput continuous cryopump is provided. The cryopump (10) incorporates an improved method for regenerating the cryopumping surface (22) while the pump is in continuous operation. The regeneration of the cryopumping surface (22) does not thermally cycle the pump, and to this end a small chamber (91) connected to a secondary pumping source (60) serves to contain and exhaust frost removed from the cryopumping surface (22) during such regeneration. The frost is exhausted at a rate substantially independent of the speed of the cryopump which enhances the capability of the pump to achieve a high compression ratio and allow the pump to operate continuously while the cryopumping surface is being regenerated.

19 Claims, 8 Drawing Figures

CONTINUOUS CRYOPUMP WITH A DEVICE FOR REGENERATING THE CRYOSURFACE

TECHNICAL FIELD

The Government has rights in this invention pursuant to Contract No. W-7405-ENG-26 awarded by the U.S. Department of Energy.

This invention relates generally to a cryopump. More particularly, it concerns a high throughput cryopump which can be operated continuously. In this connection, the cryopump includes a device for regenerating the cryopumping surface while the pump is operating.

BACKGROUND ART

The application of cryopumping has been very effective in pumping hydrogen and its isotopes at very high pumping speeds. Typical applications have included pumping space simulation chambers and high power neutral beam lines. Neutral beam injection line pumps for example pump at speeds of 250,000 l/s. These pumps are cooled with liquid helium and typically are surrounded with liquid nitrogen cooled thermal radiation shields. The operation of these pumps involves initially pumping the vacuum chamber with an auxillary pumping system, e.g., a turbo pump to a pressure at or below $10^{-4}$ torr and then chilling the pumping surfaces to 4–6 degrees K using liquid helium. The system is then put into operation with the material being pumped collected on the cold surfaces as a frozen solid frost like. Pumping can continue indefinitely unless the frost layer becomes excessively thick limiting the thermal conduction to the pumping surface. In many applications the collection of material on the pump is limited to other criteria, e.g., when pumping hydrogen it may be desirable, for safety reasons, to limit the total inventory to a value below the explosive limit inside the vacuum chamber. Also, when using tritium it is usually desirable to limit the total inventory of the radioactive gas. In all cryopumping systems to date, after one of these limits occurs, the pumps would require regeneration. This process involves warming the cryopanels, causing the cryofrost to evaporate. The evaporated frost is then pumped by the auxillary pumping system after which the pumps can be recooled and the pumping cycle repeated.

In many applications the cyclical nature of the pumping cycle cannot be tolerated. In order to pump a chamber continuously, two or more pumps are operated in tandem with the pumps isolated from the process chamber by gate valves. Another technique being developed is to close the liquid nitrogen chevrons of a tandem set of pumps during regeneration and pump the regenerated material with a separate pump which evacuates the volume inside the baffles.

High speed cryopumps also undergo a thermal instability when the process chamber goes above a certain pressure, usually in the range of $10^{-3}$ torr. The cause of this is that the process vacuum serves as cryogenic insulation for the liquid helium cooled pumping surface. Thus as the pressure in the chamber gets too high, the heat conducted through the gas overwhelms the cooling capacity and the panels spontaneously regenerate. Because of this, large cryopumps are usually designed to operate at or below $10^{-4}$ torr. This limitation restricts the throughput of the pump, or necessitates very large pumping speeds in the pump chamber. While this may in many instances be irrelevant it can impact many potential applications. For example, in a tokomak fusion reactor, the throughput of fuel will be in the range of a hundred torr liters per second while the conductance of the vacuum lines and gate valves leading to the pumps may be of the order of 10,000–100,000 l/s. In order to handle the throughput, a typical high speed cryopump operating at $10^{-4}$ torr would require a pumping speed of a million l/s, 10–100 times greater than the conductance.

Cryopumps are not alone in the inability to pump high throughputs at pressures greater than $10^{-3}$ torr as the other potential high speed pumps also develop problems. Turbomolecular pumps and diffussion pumps both lose effective pumping at $10^{-3}$ torr. The most effective pumps in this region of pressure are roots blowers which have significant difficulties in tritium applications due to the need for oil lubrication.

Accordingly, it is an object of the present invention to provide a high throughput continuous cryopump incorporating means for regenerating the cryopumping surface while the pump is in operation. More specifically, it is an object to provide a pump which has the potential of pumping 100 torr - l/s at a speed of 10,000 l/s, which is tritium compatible and can operate continuously. It is a further object of the present invention to provide such a cryopump capable of pumping at high pressures while limiting the cryopumping to a selected surface continuously cleaned by a regenerating device. This cryopumping surface is thermally insulated using a separate vacuum chamber surrounding the cryopumping surface and a metal bellows which connects the cryopumping chamber and its associated cryopumping surface to the pump inlet. It is another object of the present invention to provide such a high throughput cryopump which includes a secondary chamber which receives frost scraped or otherwise thermally removed from the cryopumping surface whereby this frost can be pumped at a higher pressure away from the cryopumping surface after removal.

Other objects and advantages of the present invention will be recognized upon reading the detailed description together with the drawings described as follows.

DISCLOSURE OF THE INVENTION

This invention is directed to a high throughput continuous cryopump. The cryopump incorporates an improved method for regenerating the cryopumping surface while the pump is in continuous operation. The regeneration of the cryopumping surface does not thermally cycle the pump, and to this end a small chamber connected to a secondary pumping source serves to contain and exhaust frost removed from the cryopumping surface during such regeneration. The frost is exhausted at a rate substantially independent of the speed of the cryopump which enhances the capability of the pump to achieve a high compression ratio and to continue operation during regeneration.

BEST MODE FOR CARRYING OUT THE INVENTION

Figure 1:
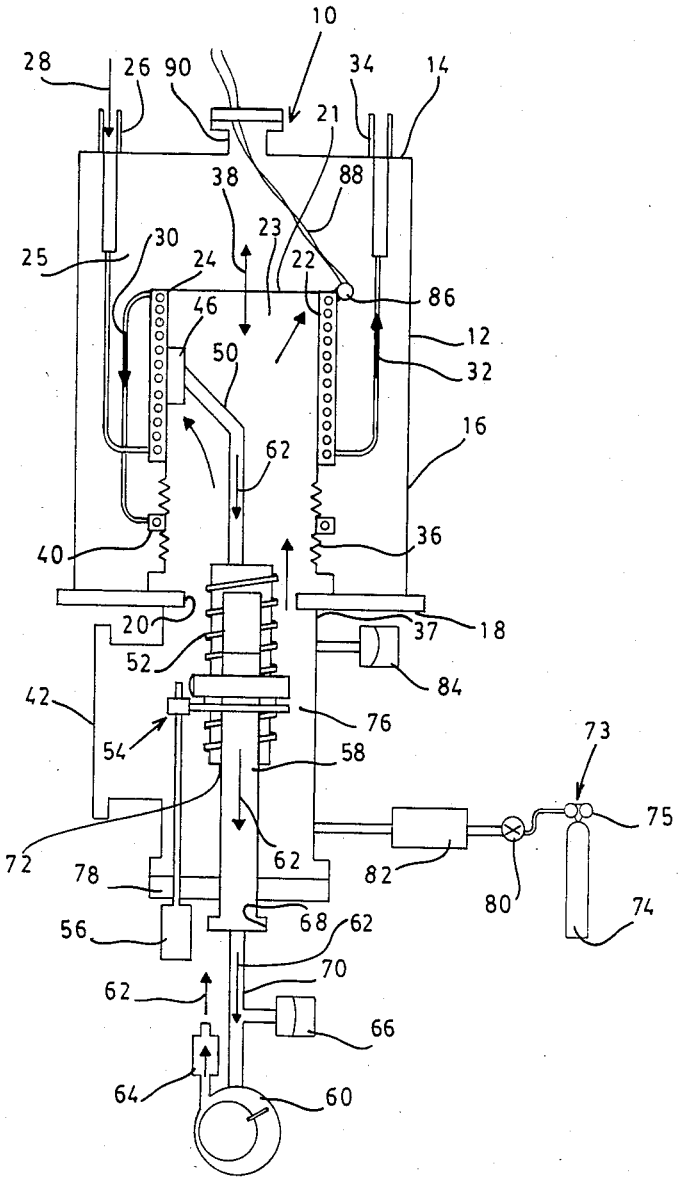
FIG. 1 depicts a diagrammatical sectional illustration of an improved high throughput continuous cryopump constructed in accordance with various features of the present invention.

Referring now to the drawings, an improved cryopump is illustrated generally at 10 in FIG. 1. This cryopump 10 includes a housing 12 which is of substantially cylindrical configuration, defining a closed upper portion 14 and a lower portion 16 which is partially closed by panel 18 having an opening 20 therein. A substantially cylindrically shaped cryopumping surface 22 is carried within the housing chamber. Typically a closure 21 atop the surface 22 defines a primary chamber of the cryopump. This cryopumping surface 22 is cooled by tubing 24 which is wrapped around and in thermal contact with the cryopumping surface 22. This tubing serves as the cooling coils which received liquid helium through the helium inlet 26. This helium flows in the direction of arrows 28, 30, 32 and exists through the outlet 34.

The cryopumping surface 22 is supported in the preferred embodiment by a bellows 36 as illustrated in FIG. 1. Bellows 36 provides a high gas conductance path for the process gas to flow from the inlet 42 which is at ambient room temperature to the cryopump surface 22 at cryogenic temperature, while restricting the heat flow to the pump. This feature facilitates the high throughput operation as will be more clearly described hereinbelow.

The bellows 36 comprises an expandable member and is cooled by the portion of the coil 40 which is wrapped or bent around the bellows and positioned in thermal contact with a section of this expandable member. In this connection, the flow of heat towards the cryopumping surface 22 from the housing 12 and/or its panel 18 is prevented. Thus, the cooling coil or similar means 40 serves to thermally insulate the cryopumping surface 22.

Additional thermal insulation between this surface 22 and the housing 14 is provided by suitable vacuum insulation generated by means of conventional design. This vacuum insulation is interposed between the pumping surface 22 and the wall of the housing 12 in vacuum chamber 25.

During operation of the cryopump 10, a gas such as heavy hydrogen is introduced through pump inlet 42. This gas flows towards the cryopumping surface 22 in the direction of the arrows indicated from chamber 76 through the opening 20 provided in the panel 18. The gas is condensed at the cryopumping surface which is maintained at a temperature substantially less than the temperature of the gases. The condensate or frost formed on the cryopumping surface 22 is then removed to regenerate this surface.

To this end, a cryopumping surface regenerating device 44 is provided. This device 44 serves to continuously regenerate the cryopumping surface 22 during the pumping operation and includes a head 46 which will be described in greater detail hereinafter, and serves to remove condensate or frost 48 (see FIGS. 2A and 2B) from the cryopumping surface 22 such that this surface 22 is continuously regenerated during the pumping operation. This head 46 is mechanically driven such that it passes over substantially all of the cryopumping surface 22. In this connection, the head 46 is mounted at the outboard end portion of a tubular support member 50 which is connected through a suitable worm gear 52, chain drive and sprockets (illustrated diagrammatically at 54) and a rotating drive source 56. Upon rotation of the worm gear 52 by energization of the drive source 56, the tubular member 50 and the head 46 are rotated such that the head follows a substantially helical path over the surface 22 of the cryopump 10. More specifically, energization of the drive source 56 serves to rotate the head 46 and to move it in a vertical direction indicated by the arrow 38 in response to the movement of the worm gear 52. After the head 46 has advanced to its maximum extension, a suitable limit switch (not shown) is encountered which caused the head to reverse its direction of rotation and move downwardly.

Condensate scraped from the cryopumping surface 22 is drawn through the tubular member 50 and the pump exhaust tube 58 by a rotary vane forepump 60. This condensate and associated gases move in the direction of the arrows 62 and are exhausted through an exhaust flow meter 64 of conventional design. A suitable exhaust manometer 66 can be provided in the illustrated conduit leading to the forepump 60 to measure exhaust pressure.

It will be noted that the condensate and gases drawn through the head 46 pass through the hollow worm gear 52, the exhaust tube 58 and the pump exhaust 68 prior to entering the conduit 70 leading to the forepump 60. A suitable rotating seal (not shown) is mounted at the location 72 and serves to prevent the escape of gases from the area between the pump exhaust tube and the internal diameter of the worm gear 52.

As necessary or desired, a suitable test gas supply 73 can be connected to the chamber 76 which is closed at its lower portion by the plate 78. This test gas flows from a pressurized storage cylinder 74 through regulator 75, valve 80, and flow controller 82 for testing the efficiency of the pump.

Further, a suitable inlet pressure manometer 84 can be provided for monitoring the inlet pressure of gases passing into the chamber 76 towards the cryopumping surface 22. It will also be noted in the illustrated embodiment that a suitable thermometer 86 can be provided for monitoring the temperature of the cooling coils in thermal contact with the cryopumping surface 22. In this regard, a silicon diode thermometer 86 of conventional design can be connected to a suitable instrument by leads 88 passing through the selectively closed port 90.

Figure 2A:
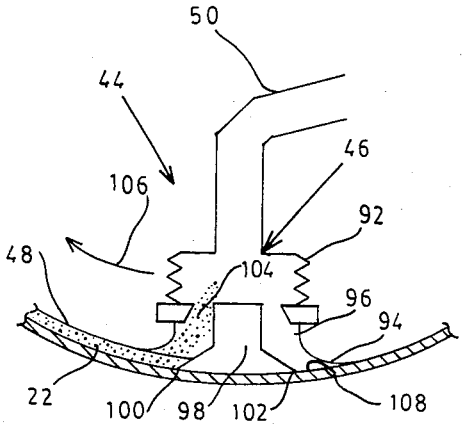
FIG. 2A depicts one embodiment of a cryopumping surface regenerating device employing a scrapper in a diagrammatical sectional view.

As discussed generally above, the condensate or frost 48 is removed from the cryopumping surface 22 by a head 46 depicted in greater detail in FIG. 2A. This head 46 is carried at the outboard end portion of the tubular support member 50 and is driven along a substantially helical path by the drive means incorporating the drive source 56 as described above. The head 46 incorporates a housing 92 which carries a metal curtain 94 defining a chamber 96 which slides over the pumping surface 22. This secondary chamber contains a scrapper 98 which is carried by the housing 92 within the curtain 94 and which defines scrapper edges 100 and 102 as shown in FIG. 2A. In operation, the frost or condensate 48 is physically removed and trapped inside the chamber 96 of the head 46. With proper orientation and by maintaining the temperature in this secondary chamber 96 defined by the curtain at a slightly elevated level with respect to the temperature on the cryopumping surface 22, the frost can be made to either evaporate and/or slide away from the cryopumping surface and be subsequently collected as a solid or evaporate and be pumped at a higher pressure away from the surface 22 by the pump 60 as it is exhausted. The compression ratio is limited only by the leakage conductance, i.e., fluid communication, between the secondary chamber 96 and the primary chamber 23 proximate the surface 22. The vacuum equations for the construction shown in FIG. 2A are as follows:

$$P_{in}S=Q_{in}+P_{ex}C$$

$$Q_{ex}=P_{ex}S_{ex}$$

where $P_{in}$ and $P_{ex}$ are the inlet and exhaust pressure in torr, i.e., the pressure at the primary pump inlet 42 and the pressure in the secondary chamber 96, respectively; $Q_{in}$ and $Q_{ex}$ are the input and exhaust gas flow in torr liter per second; S and $S_{ex}$ are the cryopump 10 and the forepump 60 pumping speeds, respectively, in liters per second; and C is the leakage conductance in liters per second between the secondary chamber 96 and the cryopump chamber 23.

In equilibrium $Q_{in}$ equals $Q_{ex}$, yielding $$Q=P_{in}S/(1+C/S_{ex})$$

so that the effective speed of the pump 10 is lowered by the ratio of the leakage of the conductance to the exhaust pump speed. Also the compression ratio of the system is $$P_{ex}/P_{in}=S/(S_{ex}+C).$$

By making the head 46 small and by using thin metal for the curtains 94 which allow passage of the frost layer at the location 104 into the head 46 while closing off the leakage paths to the primary chamber 23, a very high compression can be obtained which allows the pump to operate at high speed and high throughput while using a relatively low speed backing pump 60.

It will be noted that the head 46 is designed such that its direction of travel can be reversed with respect to the cryopumping surface 22. More specifically, in the motion depicted in FIG. 2A the direction of travel is illustrated by the arrow 106 which utilizes the scrapper edge 100 for scraping the frost 48 into the chamber 96 of the head 46 producing a cleaned surface at the location 108 behind the scrapper 98.

When the direction of travel is reversed, it will be recognized that the scrapper edge 102 serves to scrape the frost into the chamber 96 and in such event the cleaned surface will be produced behind the scrapper edge 100.

Figure 2B:
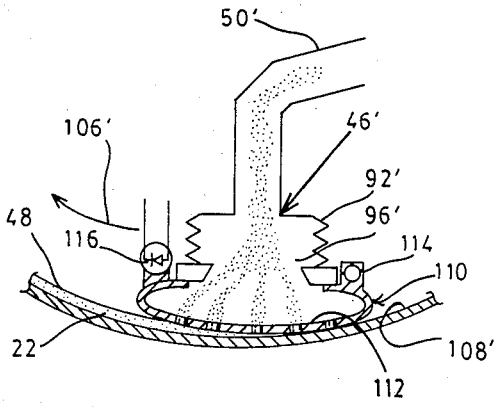
FIGS. 2B and 2C depict an alternate embodiment of a cryopumping surface regenerating device employing a heater for removing frost from the cryopumping surface.
Figure 2C:
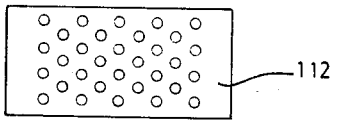

An alternate embodiment of a head 46 is shown at 46' in FIG. 2B. Parts of this head 46' which are similar and/or identical in construction with parts and components of the head 46 shown in FIG. 2A are depicted by primed numerals. This head 46' is designed to remove the frost 48 from the cryopumping surface 22 by heat rather than by scraping operations. In this connection, the curtains 94 of the head 46 shown in FIG. 2A are replaced by a heated element 110 carried by the housing 92' as illustrated in FIG. 2B. This heated element is shown in cross-sectional outline and serves to define with the housing 92' the chamber 96' into which the frost 48 travels subsequent to contact with the heated element 110. In this connection, the heated element 110 preferably comprises a contoured copper plate 112 shown in the bottom view in FIG. 2C. This copper plate is bent as illustrated in FIG. 2B to form the secondary chamber 96' with the head 92'. A plurality of openings shown in FIG. 2C and in FIG. 2B serve to vent the gas being sublimed from the cryosurface in contact with the heated plate 112 to enter the secondary chamber. The gas which enters chamber 96' passes through the tubular member 50 and is exhausted by the pump 60. The heated element 110 is in thermal contact with a cartridge heater 114 mounted in thermal contact with the element 110. This cartridge 114 is of conventional design and serves to heat the plate 112 to a desired level. Further, a cryogenic thermometer 116 is shown mounted on the plate 112 to provide information concerning the temperature of this plate to the operator. In operation, the head 46' travels in the direction of the arrow 106' and produces a cleaned surface at the location 108' as the head 46' follows its helical path over the cryopumping surface 22. When the direction of travel is reversed, the cleaned surface will be produced on the opposite side of the head.

EXPERIMENT

The cryopumping surface 22 of an experimental pump was provided by the inside surface of an 18 cm i.d. stainless steel tube having a 1.5 mm wall thickness. The outside of the cryosurface tube was wrapped with square copper tubing 24 which was soldered to the tube. Liquid helium from a storage dewar was continuously transferred through inlet 26 and a transfer line to cool the pump. The cryopump was itself contained inside a separately pumped vacuum chamber 25 (FIG. 1). The internal cryopumping surface was connected to a room temperature duct 37 through a pair of metal bellows 36 with a helium exhaust tracer serving as cooling means 40 intercepting heat flow up the bellows. A chevron could also be placed midway up the bellows but was not used in this experimental arrangement so that the head scaping the frost could be observed with a tv camera looking up from the bottom of the pump through a window in opening 20. The use of the bellows enables a high conductance path to the cryopump with a low heat leak. This configuration is cryostable since the thermal conduction through the gas is negligible. Typically high speed cryopumps attempt to maximize both the cryopumping surface area and the conductance into the pump which leads to an open geometry which when operated at high pressure causes a severe heat leak to the pumps. Thus by compromising the speed of the pump a cryostable configuration was achieved.

The available cryopumping surface 22 in the prototype pump was 320 $cm^2$. A throughput of 100 torr liters/s would result in a frost accumulation of 0.3 mm/min. assuming that the frost is a dense packed solid. This rapid accumulation of frost could lead to a saturation of the pumping speed due to the poor thermal conduction of solid hydrogen.

The head 46 is attached to and driven by a mechanism 56 and the operatively associated drive chain (including gear 52, and the chain drive and sprockets 54) which are designed to allow it to scrape the inside surface of the cylindrical cryocondensation surface. A lead screw 52 driven through a rotary vacuum feedthrough by a fractional HP dc gear motor 56, moved the head 46 in a helical motion around and up the walls of the chamber. The motion reverses at the top and the head 46 returns down the surface. A complete cycle required approximately 2 minutes.

Two different types of heads were tested, a mechanical head 46 which scrapes the frost from the cryosurface and a thermal head 46' which sublimes the frost from the surface. The mechanical head 46 shown in FIG. 2A consists of two knife edges 100 and 102 to scrape the frost and a pair of thin metal curtains which ride over the cryosurface to seal off the secondary chamber from the process chamber 23. A heater 114 and a silicon diode cryogenic thermometer 116 were attached to the head so that the scraped frost 48 can be sublimed inside the head. The thermal head shown in FIG. 2B consists of a copper "box" with a surface contoured to fit flush with the cryosurface. When heated, the metal plate 112 which is pressed against the cryosurface warms the surface of the cryofrost causing the frost to sublime. Holes drilled through the plate allow the evaporated cryofrost to vent into the exhaust duct. The edges of the box serve the same function as the metal curtains, limiting the backflow of sublimed gas from the secondary chamber into the process chamber. The head was attached to the drive tube with a bellows with springs (not shown) added to force the head to press against the cryosurface with 3 pounds of force.

Since this cryopump 10 is a true throughput pump as opposed to a collector pump, a forepump is used to back the pump. Several rather conventional pumps could be employed. For tritium applications, an all metal scroll pump or bellows pump could be used. Alternatively, the scraped solid and evaporated gases could be collected in a solid hydrogen extruder and be pumped as a cryogenic solid directly to high pressure (100 atmos.) or be fabricated into pellets for fusion fueling applications. For the tests conducted, a conventional two stage rotary vane pump 60 with an inlet molecular sieve trap was used as the forepump. The effective speed of the forepump including the trap and the vacuum lines was measured to be 11.7 liters per second for deuterium and 10.7 liters per second for argon.

A two-inch diffusion pump (not shown) was used to evacuate the cryogenic insulation vacuum space or chamber 23 surrounding the pump. A gas flow controller 82 (0–100 torr liters per second) was used to admit and measure the flow of test gas to the pump. A second flowmeter 64 was installed on the rotary vane pump to measure the exhaust flow from the pump. Capacitance manometers were used to measure the process chamrer vacuum (tb q–1 torr) and the exhaust pressure (0–10 torr). Silicon diode cryogenic thermometers were used to measure the temperature of the head and the cryopump surface.

Figure 3A:
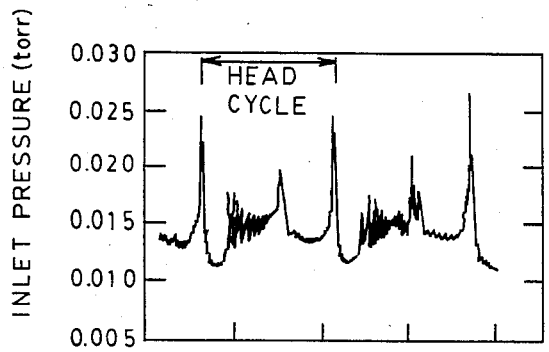
FIGS. 3A and 3B illustrate the variations in the inlet pressure and gas flow versus time, respectively, during selected cycles of the regenerating device.
Figure 3B:
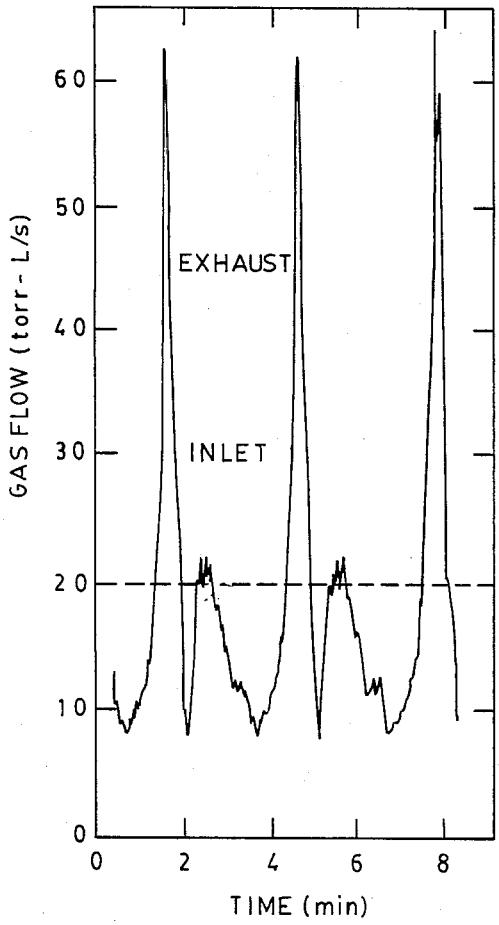

Tests of the mechanical head pump were performed with deuterium gas. After cooldown of the pump to a temperature below 6 K, deuterium was admitted to the head 46 and the temperature of the head 46 dropped from a value near 90 K during the start of the test to below 20 K. When the temperature dropped below 20 K., the exhaust flow and exhaust pressure dropped and the head ceased pumping while the pump continued operation. This is probably due to the frost accumulating inside the head causing the exit ports to plug. With the addition of heat to the head, the pumping action resumed. The head temperature was then regulated at 70 K. for the remainder of the test. Up to a flow of 30 torr l/s, the pumping was stable and continuous. FIG. 3 shows a portion of the time history of the inlet and exhaust pressure for an inlet of 20 torr l/s. The exhaust pressure at a given moment of time is proportional to the amount of frost being "eaten" by the head, which is proportional to the frost thickness. The regular variation of the exhaust pressure is due to a combination of two effects. First, the motion of the head is reciprocal so that on the start of the return motion, it is removing frost from a region of the pump which it had just cleaned, thus a sawtooth fluctuation of the exhaust would be expected. Second, the accumulation of frost in the pump is probably not uniform from top to bottom. Due to the geometry, more gas is pumped near the bottom (entrance) of the pump than the top. These two effects combine to account for the variation in exhaust flow with the average exhaust flow equal to the inlet flow. The process chamber pressure can be simulated with a pumping speed of 2000 l/s, a head conductance of 4 l/s and an exhaust pumping speed of 11.7 l/s; the variation of the pressure being due to a backflow of gas from the head into the process chamber. This effect determines the size of backing pump required. At a flow of 50 torr l/s, a large fluctuation in the process vacuum occurred which was due to a rise in cryosurface temperature to a value at which the equilibrium vapor pressure of the frost was higher than the process vacuum. The limit of the throughput was the cooling limit of the liquid helium transfer system estimated at 20–30 l/hr of liquid helium. An early version of this pump with a liquid bath cooling system and a liquid nitrogen cooled baffle was capable of much higher instantaneous throughputs. The bath pump was tested to determine if it could pump pressure bursts of hydrogen propellent used in the pneumatic pellet accelerators. Gas bursts of 90 torr liters from a solenoid valve were pumped stably at a rate of five per second for six seconds, a throughput of 450 torr liters/s.

Figure 4A:
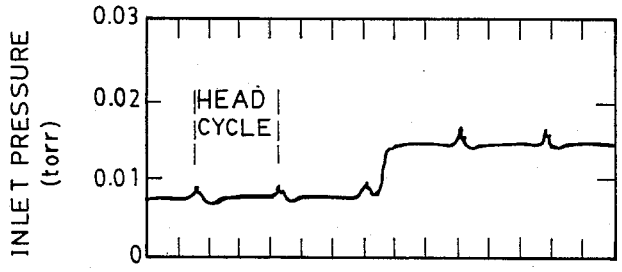
FIGS. 4A and 4B illustrate variations in the inlet pressure and exhaust pressure versus time, respectively, during a cyling of the regenerating device.
Figure 4B:
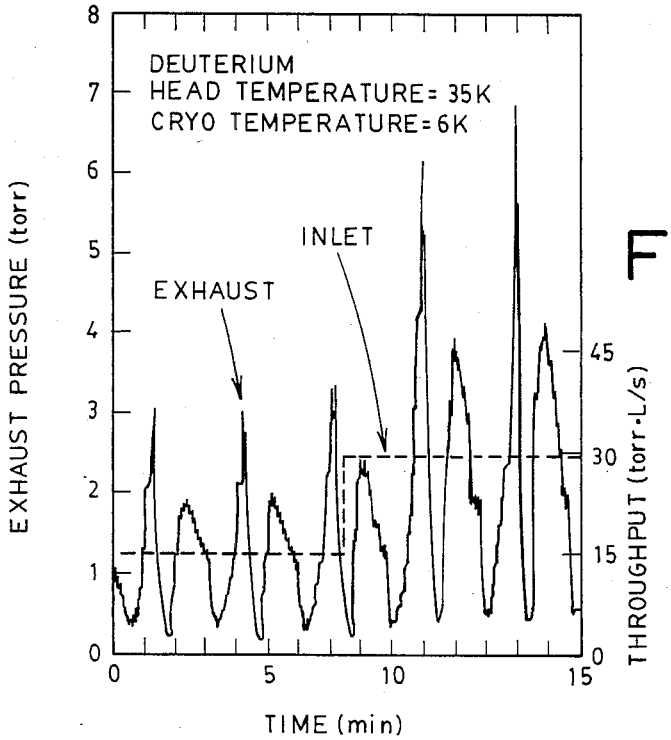

Test data using the thermal head 46' are shown in FIG. 4. When pumping deuterium, the thermal head performs in much the same manner as the mechanical head except that it has a signifigantly lower leakage conductance, 1 l/s versus 4 l/s for the mechanical head. This results in smaller pressure fluctuations in the process chamber. The response of the inlet pressure and the exhaust pressure to a step increase in the inlet flow is also shown. The inlet pressure shows an immediate response which is proportional to the inlet flow as would be expected for a constant pumping speed. The integrated exhaust flow also responds in proportion to the increased inlet flow but is delayed by one cycle time of the head.

Another difference between the mechanical head 46 and thermal head 46' was that the thermal head was capable of pumping argon. When pumping argon using the mechanical head, the head chattered and was generally not built with sufficient mechanical ridigity to shave the stronger argon frost. The thermal head performed quite well with argon, at a throughput of 60 torr l/s the process chamber was maintained at 0.047–0.050 torr or a speed of 1,275 l/s. The head was maintained at 240 K. using 70 watts of heater power, the cryosurface was maintained at 30 K., the helium consumption was estimated at 20–30 liters per hour.

The construction of this pump was intended to demonstrate the feasibility of continuously regenerating a high throughput cryocondensation pump in order to minimize the inventory of material in the pump. The three aspects of this problem, high throughput - low inventory - and continuous regeneration, are interrelated. Without high throughput, the problem of regeneration and inventory are not really severe. Producing a practical cryopump that can handle high throughputs requires a solution to the regeneration problem since the pumps would saturate or acquire too much inventory in an unreasonably short time. The application of this pump 10, therefore, will probably be in systems which have high throughputs of gas and require high speed ultra-clean pumping.

The very high compression ratio demonstrated in this pump has two important aspects. First, the compression ratio will increase linearly with the pumping speed of the pump. Therefore, the same backing pump can be used for a 10,000 l/s pump as that in a 1000 l/s pump. Second, the compression ratio is large enough that an all metal scroll pump or perhaps a metal bellows pump would be adequate to back the pump.

Several improvements and refinements of this pump are envisioned. First is a change in the drive mechanism of the head and geometry of the cryosurface so that a steady exhaust pressure is produced. This would have the effect of increasing further the usable compression ratio while reducing or eliminating the pressure fluctuations in the cryopump. Further, the head could be driven completely through suitable bellows feedthroughs thereby removing the drive mechanisms from the cryopump. When combined with an all metal forepump, this would produce pumping system in which there were no materials in contact with the process gas other than stainless steel. A closed cycle refrigeration system would also enhance the practicality of the pump.

While the demonstration pump was a cryocondensation pump, the basic principle of operation of the pump could be applied to continuously regenerate a cryosorption pump. In such a system a cryosorption material with a relatively smooth surface would be used so that a low conductance seal could be made between the surface and the head. Selective heating of the cryosorption material could be produced using infrared or microwave power to directly heat the cryosorption layer as it passes through the head chamber.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A cryopump adapted for regeneration during cryopumping operation for a selected gas, comprising:

a pump housing defining an interior volume;

a cryopumping surface within said interior volume of said pump housing in fluid communication with an inlet for said gas;

cryogenic cooling means in thermal contact with said cryopumping surface, said cooling means and said cryopumping surface maintained at a temperature substantially less than said gas to condense said gas and produce a condensate of said gas on said cryopumping surface;

a cryopumping surface regeneration means for selectively removing said condensate from said cryopumping surface and expelling said removed condensate from said cryopump while said cryopump is in operation whereby said cryopump can continuously operate without thermal cycling of said cryopumping surface while said cryopumping surface is being regenerated, said surface regeneration means defining a secondary chamber proximate said cryopumping surface to remove and to receive said removed condensate without affecting pressure within said cryopump.

2. The cryopump of claim 1 wherein said cryopumping surface defines a primary chamber, and further includes thermal insulation means for mounting and thermally isolating said cryopumping surface from said pump housing, said insulation means providing a fluid communication means between said cryopumping surface and said inlet for said gas serving to allow a high conductance for said gas while having a low heat transfer, and further providing cooling means in thermal contact with said fluid communication means at a selected location to further assist in preventing heat flow to said cryopumping surface through said fluid communication means.

3. The cryopump of claim 2 wherein said thermal insulation means for thermally insulating said cryopumping surface further includes providing a vacuum within said volume of said housing surrounding said cryopumping surface to assist in preventing heat flow to said cryopumping surface.

4. The cryopump of claim 3 wherein said surface regeneration means comprises:

a head defining said secondary chamber;

means for moving said head over said condensate formed on said cryopumping surface;

means for removing said condensate from said cryopumping surface to within said secondary chamber; and vacuum means connected to said secondary chamber to expell said removed condensate from said cryopump.

5. The cryopump of claim 1 wherein said surface regeneration means comprises:

a head defining said secondary chamber;

means for moving said head over said condensate formed on said cryopumping surface;

means for removing said condensate from said cryopumping surface to within said secondary chamber; and vacuum means connected to said secondary chamber to expell said removed condensate from said cryopump.

6. The cryopump of claim 5 further including means for isolating said primary chamber from said secondary chamber whereby said secondary chamber can be evacuated with said vacuum means to expell said condensate removed from said cryopumping surface at a rate less than and substantially independent of pumping rate within said primary chamber to thereby increase the effective compression ratio and to allow said regeneration of said cryopump during said cryopumping operation.

7. A high throughout continuous cryopump adapted for regeneration during cryopumping operation for selected gases, comprising:

a cryopumping surface defining a primary chamber;

cooling means in thermal contact with said cryopumping surface for maintaining said cryopumping surface at a temperature substantially less than required for said gases to be condensed on said cryopumping surface;

a housing for receiving said cryopumping surface, said housing provided with an inlet through which said gases are admitted to said cryopumping surface;

a cryopumping surface regeneration means to selectively remove said condensed gases from said cryopumping surface of said cryopump while said cryopump is in operation, said regeneration means defining a secondary chamber proximate said cryopumping surface to receive said removed condensed gases and provided with means for movement across said surface; and exhaust means connected to said secondary chamber for exhausting said removed condensed gases from said cryopump while said cryopump is in operation.

8. The cryopump of claim 7 wherein said cryopumping surface defines a primary chamber and is thermally isolated from, and mechanically connected to, said housing by mounting means, said mounting means providing fluid communication between said cryopumping surface and said inlet in said housing for said gases and a high conductance for said gases while having a low heat transfer, said mounting means provided with cooling means in thermal contact with said mounting means at a selected location to assist in preventing heat flow to said cryopumping surface through said mounting means.

9. The cryopump of claim 7 wherein said cryopumping surface regeneration means for selectively removing said condensed gases from said cryopumping surface includes:

a head which transfers said condensed gases from said cryopumping surface, said head containing said secondary chamber, said secondary chamber being isolated from said primary chamber;

a drive means connected to said head to drive said head across said cryopumping surface; and vacuum means connected to said secondary chamber for exhausting said removed condensed gases from said head for discharge exterior to said cryopump.

10. The cryopump of claim 9 wherein said head comprises:

a head housing defining said secondary chamber, said head housing provided with an outlet connected to said vacuum means; and scraper means attached to said housing to mechanically remove said condensed gases from said cryopumping surface as said head is moved across said cryopumping surface.

11. The cryopump of claim 10 further comprising:

curtain means extending from said head to slidably contact said cryopumping surface housing to provide said isolation of said secondary chamber from said primary chamber; and heater means within said secondary chamber to vaporize said removed condensate.

12. The cryopump of claim 9 wherein said head comprises:

a head housing defining said secondary chamber, said head housing provided with an outlet connected to said vacuum means; and heating means carried by said head housing to thermally remove said condensed gases from said cryopumping surfaces as said head is moved across said cryopumping surface.

13. A high throughout continuous cryopump adopted for regeneration during continued cryopumping operation for selected gases, which comprises:

a pump housing defining an interior volume, said pump housing provided with an inlet to admit said gases to said cryopump;

a substantially smooth cryopumping surface within said interior of said pump housing, said cryopumping surface defining a primary chamber isolated from said interior volume of said housing;

cryogenic cooling means in thermal contact with said cryopumping surface, said cryogenic cooling means and said cryopumping surface maintained at a temperature substantially less that said gases to condense said gases and produce a condensate of said gases on said cryopumping surface;

mounting means for mounting said cryopumping surface in said pump housing, said mounting means providing fluid communication between said inlet and said primary chamber for providing a high conductance of said gases to said cryopumping surface, said mounting means characterized by low head transfer and having cooling means attached thereto to thermally isolate said cryopumping surface from said housing;

a cryopumping surface regeneration means for removing said condensate of said gases while said cryopump is in operation, said regeneration means having a head defining a secondary chamber for movement across said cryopumping surface to remove said condensate, and a drive means for moving said head across said cryopumping surface; and pumping means connected to said secondary chamber for exhausting said removed condensate from said head for discharge exterior to said cryopump.

14. The cryopump of claim 13 wherein said cryopumping surface is an inner surface of a cylinder, wherein said drive means moves said head across said cryopumping surface in a spiral pattern; and wherein said drive means includes reversing switches whereby said head is moved in a spiral path from one end of said cryopumping surface to a second end, and then in an opposite direction spirally across said cryopumping surface whereby said head is moved substantially across all of said cryopumping surface.

15. The cryopump of claim 13 wherein said head comprises:

a head housing defining said secondary chamber, said head housing provided with an outlet connected to said vacuum means; and scraper means attached to said head housing to mechanically remove said condensed gases from said cryopumping surface as said head is moved across said cryopumping surface.

16. The cryopump of claim 15 further comprising:

curtain means extending from said head housing to slidably contact said cryopumping surface to provide said isolation of said secondary chamber from said primary chamber; and heating means within said secondary chamber to vaporize said removed condensate.

17. The cryopump of claim 13 wherein said head comprises:

a head housing defining said secondary chamber, said head housing provided with an outlet connected to said vacuum means; and heating means carried by said head housing to thermally remove said condensed gases from said cryopumping surfaces as said head is moved across said cryopumping surface.

18. The cryopump of claim 13 wherein said cryopumping surface is a cryocondensation surface.

19. The cryopump of claim 13 wherein said cryopumping surface is a cryosorbtion surface.

* * * * *